United States Patent [19]

Hara et al.

[11] 4,450,209

[45] May 22, 1984

[54] MULTI-LAYER SURFACE-TREATED STEEL PLATE HAVING ZINC-CONTAINING LAYER

[75] Inventors: Tomihiro Hara; Masahiro Ogawa; Masaaki Yamashita, all of Yokohama, Japan

[73] Assignee: Nippon Kokan Kabushiki Kaisha, Tokyo, Japan

[21] Appl. No.: 447,523

[22] Filed: Dec. 7, 1982

[30] Foreign Application Priority Data

Dec. 8, 1981 [JP] Japan ..... 56-196316

[51] Int. Cl.[3] ..... C25D 3/22; E32G 15/08

[52] U.S. Cl. ..... 428/626; 428/623; 428/632; 428/629; 428/658; 428/659; 428/928; 204/28; 204/14 R

[58] Field of Search ..... 428/623, 626; 204/14 R

[56] References Cited

U.S. PATENT DOCUMENTS

| | | | |
|---|---|---|---|
| 2,540,108 | 2/1951 | Fisher | 428/623 |
| 4,237,192 | 12/1980 | Ito et al. | 428/626 |
| 4,304,822 | 12/1981 | Heyl | 428/626 |

FOREIGN PATENT DOCUMENTS

| | | |
|---|---|---|
| 54-77635 | 3/1979 | Japan . |
| 55-62971 | 2/1980 | Japan . |
| 1562651 | 3/1980 | United Kingdom . |

*Primary Examiner*—Veronica O'Keefe

*Attorney, Agent, or Firm*—Frishauf, Holtz, Goodman & Woodward

[57] ABSTRACT

A multi-layer surface-treated steel plate comprises a zinc-containing plated layer, a lithium silicate film layer formed on said plated layer and an organic composite silicate film layer composed of colloidal silica and an organic resin, which is formed on the lithium silicate film layer.

8 Claims, No Drawings

MULTI-LAYER SURFACE-TREATED STEEL PLATE HAVING ZINC-CONTAINING LAYER

BACKGROUND OF THE INVENTION (1) Field of the Invention

The present invention relates to a multi-layer surface-treated steel plate having a zinc-containing layer, and the present invention provides a surface-treated steel plate excellent in the rust proofness, paint adhesion and corrosion resistance of the coating.

(2) Description of the Prior Art

As the surface-treated steel plate to be employed as a substrate to be coated in the field of production of household electric appliances or construction materials, there have broadly been used products obtained by forming a phosphate treatment layer or chromate treatment layer on a zinc-deposited steel plate. In a chromate-treated zinc-deposited steel plate, a good corrosion resistance can be obtained owing to the passivating action of chromium, but there are problems concerning the toxicity of chromium and the waste water treatment. The phosphate treatment provides an undercoating having excellent properties, but in order to obtain a sufficient corrosion resistance, the chromic acid treatment should be performed as the post treatment and because of this post treatment, the same problems as encountered in the chromate treatment arise and furthermore, a problem of disposal of sludges formed in large quantities arises. Moreover, surface-treated steel plates obtained by either the chromate treatment or the phosphate treatment are still insufficient as substrates to be coated in the corrosion resistance of the coating, the paint adhesion and the degreasing resistance. Accordingly, development of a surface-treated steel plate having excellent, well-balanced properties as a substrate to be coated has been desired in the art.

As the surface-treatment method for solving the foregoing problems, there has been proposed a method using a silicate composite composed of silica and an acrylic copolymer (see Japanese Patent Publication No. 34406/79), and some improvements of this methods have been proposed in Japanese Patent Application Laid-Open Specifications No. 77635/79 and No. 62971/80. However, when this silicate composite (hereinafter referred to as "organic composite silicate") is applied to a zinc-deposited or zinc alloy-deposited steel plate, the paint adhesion is improved over the paint adhesion attained by the existent chromate treatment or phosphate treatment, but the corrosion resistance in either the uncoated state or the coated state is insufficient and it is desired to further improve the corrosion resistance.

SUMMARY OF THE INVENTION

It is a primary object of the present invention to provide a multi-layer surface-treated steel plate in which the foregoing problems involved in the conventional techniques can effectively be solved.

More specifically, in accordance with the present invention, there is provided a multi-layer surface-treated steel plate comprising a zinc-containing plating layer, a lithium silicate film layer formed on said plating layer and an organic composite silicate film layer composed of colloidal silica and an organic resin, which is formed on the lithium silicate film layer.

DETAILED DESCRIPTION OF THE INVENTION

The multi-layer surface-treated steel plate of the present invention comprises as a substrate a zinc-deposited steel plate or a zinc alloy-deposited steel plate and is characterized in that a lithium silicate [$Li_2O.nSiO_2$ in which n is a number of from 2 to 20] film layer is formed on the surface of the zinc-containing layer of the substrate and an organic composite silicate film layer obtained by reacting and coupling colloidal silica with an organic resin is formed on the lithium silicate film layer.

In the organic composite silicate film formed from colloidal silica and an organic resin, the organic resin component has mainly an effect of improving the paint adhesion while the silicate component (colloidal silica) has an effect of improving the corrosion resistance. However, in the case where this organic composite silicate film alone is applied, the corrosion resistance in either the uncoated state or the coated state is inferior. The reason is considered to be as follows.

In the case where the silicate component in the organic composite silicate film forms a dense film on the entire surface of the plating layer, dissolution of the zinc plating film is controlled and an excellent corrosion resistance can be attained. Practically, however, areas not covered with the silicate are locally formed on the surface of the plating layer, resulting in reduction of the corrosion resistance. Accordingly, in order to improve the corrosion resistance of the organic composite silicate film, a dense silicate film is formed as a first layer and an organic composite silicate film is formed as a second layer on the first layer. The present invention has been completed based on the results of our researches made on this two-film-layer structure.

The lithium silicate film as the first layer can be formed by coating an aqueous solution of lithium silicate [$Li_2O.nSiO_2$ in which n is a number of from 2 to 20], drying the coating, washing the coating and drying the coating again. As the film-forming silicate, there can be mentioned not only lithium silicate but also alkaline silicates such as sodium silicate, potassium silicate and amine silicate, and sol-like colloidal silica. However, silicates other than lithium silicate have no substantial effect. In case of an alkaline silicate other than lithium silicate, the alkaline component left on the surface of the silicate film inhibits bonding of the silicate film to the organic composite silicate film. On the other hand, in case of lithium silicate, since the alkaline component left on the surface is sufficiently removed by water washing, a good adhesion is attained between the silicate film and the organic composite silicate film. It is considered that this is the reason why a steel plate substrate having excellent properties can be obtained. When colloidal silica is used for the silicate film of the first layer, there is obtained no effect. It is construed that the reason is that since colloidal silica is composed of particles, the formed film is a porous film having many defects and hence, the corrosion resistance of the organic composite silicate film cannot be improved by this porous film.

The lithium silicate film will now be described.

The molar ratio n in lithium silicate $Li_2O.nSiO_2$ is preferably in the range of from 2 to 20, and if the molar ratio is 4 or higher, the boiling water resistance and corrosion resistance of the coating tend to increase. If the molar ratio n is lower than 2, the alkaline component ($Li^+$) is left on the surface of the lithium silicate film, and if the molar ratio n is higher than 20, the properties of the lithium silicate film become similar to those of the colloidal silica film. Accordingly, no good results can be obtained unless the molar ratio n is in the range of from 2 to 20.

The amount of the lithium silicate film deposited on one surface (as calculated as $SiO_2$) is ordinarily in the range of 0.001 to 1 g/m$^2$, preferably 0.01 to 0.5 g/m$^2$. If this amount is smaller than 0.001 g/m$^2$, no substantial effect can be attained, and if the amount is larger than 1 g/m$^2$, since the processability of the silicate film is inferior, no good undercoating can be obtained because of reduction of the paint adhesion though the corrosion resistance is improved. In order to obtain a lithium silicate film having a thickness within this range, it is preferred that the concentration of an aqueous solution of lithium silicate be 0.1 to 500 g/l, especially 5 to 200 g/l, as calculated as $SiO_2$. From the viewpoint of the adaptability to the coating operation, it is preferred that the temperature of the lithium silicate solution be 0° to 70° C., especially 20° to 50° C. If the solution temperature is lower than 0° C., the solution is frozen and solidified, and if the solution temperature is higher than 70° C., the tendency of solidification is enhanced and the solution becomes very unstable.

Coating of lithium silicate can be accomplished by customary coating methods such as dip coating, spray coating, shower coating and roll coating. Drying of the coating is advantageously accomplished by hot air drying, and baking at a high temperature (100° to 200° C.) is not especially necessary. When the solution temperature is relatively high, the coating can sufficiently be dried by natural drying.

Water washing is carried out for removing the alkaline component left on the surface of the lithium silicate film. The intended effect can sufficiently be attained by using water having a pH value of 6 to 8 which is customarily used for water washing. In order to remove the alkaline component completely, pickling may be performed. Water washing or pickling may be carried out not only at normal temperatures but also at lower or higher temperatures. A higher washing effect can be obtained at a higher temperature and the drying time can be shortened. Accordingly, a higher temperature is prefered from the viewpoint of the operation efficiency.

If the above-mentioned lithium silicate film alone is formed, the corrosion resistance is insufficient in either the uncoated state or the coated state, and furthermore, the paint adhesion is extremely poor and no satisfactory surface-treated steel plate can be obtained. However, if this lithium silicate film is combined with an organic composite silicate film according to the present invention, an excellent surface-treated steel plate which is satisfactory in both the corrosion resistance and the paint adhesion can be obtained.

The organic composite silicate film as the second layer will now be described in detail.

The intended effect can be attained if the amount of the organic composite silicate film deposited on one surface is 0.1 to 4.0 g/m$^2$, and it is preferred that this amount be 0.5 to 3.0 g/m$^2$. If this amount is smaller than 0.1 g/m$^2$, no substantial effect can be attained. If this amount is larger than 4 g/m$^2$, the quality is improved to some extent but no prominent improvement can be attained, and therefore, the production becomes economically disadvantageous and continuous multiple spot welding is difficult, with the result that the practical utility of the surface-treated steel plate is drastically reduced.

The sysnthesis of the organic composite silicate that is used in the present invention is performed according to the method disclosed in Japanese Patent Publication No. 34406/79. More specifically, the organic composite silicate can be obtained by mixing colloidal silica, a water-soluble or water-dispersible organic resin and a trialkoxysilane compound and reacting this three-component mixture at a temperature higher than 10° C. but lower than the boiling point of the mixture.

Colloidal silica is water-dispersible silica called "silica sol", and commercially available products supplied by Nissan Kagaku K.K., Du Pont Co., USA, and other companies may be directly used. An acidic or basic product is appropriately selected and used according to the stable pH range of the organic resin used.

Any of organic resins capable of being stably mixed with colloidal silica can be used for formation of the organic composite silicate. For example, there can be used resins containing hydrophilic groups such as hydroxyl, carboxyl and amino groups, such as an acrylic copolymer, an alkyd resin, an epoxy resin, a fatty acid- or polybasic acid-modified polybutadiene resin, a polyamine resin and a polycarboxylic acid resin, and mixtures and addition condensates of two or more of them, so far as they are water-soluble or water-dispersible.

A so-called silane coupling agent commercially available can be used as the trialkoxysilane compound as the third component of the organic composite silicate. For example, there can be mentioned vinyltriethoxysilane, vinyl-tris($\beta$-methoxyethoxy)silane, $\gamma$-glycidoxypropyltrimethoxysilane, $\gamma$-methacryloxypropyltrimethoxysilane, N-$\beta$-(minoethyl)-$\gamma$-aminopropyltrimethoxysilane and $\gamma$-aminopropyltriethoxysilane.

In the organic composite silicate that is used in the present invention, the colloidal silica/organic resin mixing weight ratio as solids is in the range of from 5/95 to 95/5, preferably from 20/80 to 50/50. It is preferred that the amount used of the silane compound as the third component be 0.5 to 15% by weight based on the total amount of the colloidal silica and organic resin as solids.

In order to further improve the quality and capacity of the surface-treated steel plate, an alkoxide compound, an oxyacid of vanadium and a salt thereof may be added to a solution for the organic composite silicate treatment according to need. More specifically, if at least one member selected from these additives is added in an amount of up to 14% by weight, preferably 0.2 to 8% by weight, based on the total solids, the corrosion resistance of the coating can further be improved.

Alkoxide compounds of titanium and zirconium are preferred as the alkoxide compound. The alkoxide compounds of titanium and zirconium are co-ordination compounds having a functionality of at least 2 (preferably 2 or 3), which are formed by linking an alkoxide compound represented by the general formula $R^1{}_2M(R^2)_2$, $R^1M(R^2)_3$ or $M(R^2)_4$ in which M stands for titanium or zirconium, $R^1$ stands for a substituent such as an ethyl, amyl, phenyl, vinyl, p-(3,4-epoxycyclohexyl), $\gamma$-mercaptopropyl or aminoalkyl group and $R^2$ stands for an alkoxy group having ordinarily 1 to 8 carbon atoms, such as a methoxy, ethoxy, n-propoxy, isopropoxy, n-butoxy, isobutoxy, sec-butoxy, tert-butoxy, n-pentoxy, isopentoxy, n-hexethoxy, n-heptoxy or n-octoxy group, with a ligand selected from a dicarboxylic acid such as maleic acid, a hydroxycarboxylic acid such as lactic acid or tartaric acid, ethylene glycol, a diketone such as diacetone alcohol or acetyl acetone, an ester such as ethyl acetoacetate or ethyl malonate, a ketone ester, salicylic acid, catechol, pyrogallol or an alkanol amine such as triethanol amine, diethanol amine or dimethylaminoethanol.

The oxyacid of vanadium and its salt includes vanadium trioxide ($V_2O_3$), vanadium pentoxide ($V_2O_5$), lithium orthovanadate ($Li_3VO_4$), sodium orthovanadate ($Na_3VO_4$), lithium metavanadate ($LiVO_3.2H_2O$), potassium metavanadate ($KVO_3$), sodium metavanadate ($NaVO_3.4H_2O$), ammonium metavanadate ($NH_4VO_3$) and sodium pyrovanadate ($Na_4V_2O_7$).

The additive mentioned above is added in the above-described preferred amount. If the additive is added in an excessive amount, the effect of the organic composite silicate film is reduced and the properties of the surface-treated steel plate are degraded. Furthermore, the crosslinking reaction is promptly advanced and the viscosity of the treating solution is increased, and no good results can be obtained.

It is believed that the above-mentioned additive acts as a crosslinking agent and reduces the amount of hydrophilic groups left in the organic composite silicate film to increase the crosslinking density of the film, with the result that the corrosion resistance of the coating is improved.

The organic composite silicate may be coated, as in case of lithium silicate, by customary coating methods such as dip coating, spray coating, shower coating and roll coating.

The zinc or zinc alloy plating layer to be formed on the starting steel plate in the present invention will now be described.

Deposition of zinc or a zinc alloy may be accomplished according to a customary electroplating method or hot dipping method. At least one element selected from Fe, Ni, Al, Co, Cr, Mo, W, Pb and Sn is added to the zinc or zinc alloy plating solution.

The present invention will now be described in detail with reference to the following Example that by no means limits the scope of the invention.

EXAMPLE

Acrylic composite silicate and epoxy composite silicate were first synthesized according to the following procedures.

[A] Synthesis of Acrylic Composite Silicate

A four-neck flask having a capacity of 1 liter, which was provided with a thermometer, a stirrer, a cooler and a dropping funnel, was charged with 180 parts of isopropyl alcohol, and the inside atmosphere was replaced by nitrogen and the inner temperature of the flask was adjusted to about 85° C. Then, a monomer mixture comprising 140 parts of ethyl acrylate, 68 parts of methyl methacrylate, 15 parts of styrene, 15 parts of N-n-butoxymethyl acrylamide, 38 parts of 2-hydroxyethyl acrylate and 24 parts of acrylic acid, together with a catalyst consisting of 6 parts of 2,2'-azobis(2,4-dimethylvaleronitrile), was added dropwise to the charge of the flask over a period of about 2 hours. After completion of the dropwise addition, reaction was conducted for 5 hours at the same temperature to obtain a colorless transparent resin solution having a solid content of 63% and an acid value of 67. Then, 45 parts of 38% aqueous ammonia was incorporated into 500 parts of the so-obtained acrylic copolymer resin solution, and water was added to the mixture and the mixture was sufficiently stirred to obtain an aqueous dispersion of an acrylic copolymer having a solid content of 20% and a pH value of 9.5. A flask was charged with 300 parts of this aqueous dispersion, and a predetermined amount of colloidal silica (supplied under the tradename of "Snowtex N" by Nissan Kagaku Kogyo K.K.) was added at room temperature with sufficient stirring. Then, 1 part of γ-methacryloxypropyltrimethoxysilane (supplied under the tradename of "KBM 503" by Shinetsu Kagaku Kogyo K.K.) was dropped to the charge of the flask with stirring, and the mixture was heated at 85° C. and maintained at this temperature for 2 hours to effect reaction, whereby a milky white, water-dispersible acrylic composite silicate having a solid content of 20% and a silicate content of 40% as solids was obtained.

[B] Synthesis of Epoxy Composite Silicate

A flask was charged with 62 parts of a bisphenol A type epoxy resin having an epoxy equivalent of 950 (supplied under the tradename of "Epikote 1004" by Shell Chemical Co.), 19 parts of linseed oil, 19 parts of tung oil and 3 parts of xylene, and the mixture was gradually heated to 240° C. under circulation of nitrogen and was fluxed for 2 hours at this temperature. Then, the reaction mixture was cooled, and when the temperature was lowered to 70° C., 40 parts of ethylene glycol monoethyl ether was added to the mixture to obtain a fatty acid-modified epoxy resin solution having a solid content of about 70%, an acid value of about 54 and a hydroxyl group equivalent of about 520. According to the same method as described above with respect to the acrylic composite silicate [A], an epoxy composite silicate was obtained by using the so-prepared epoxy resin.

An electrically zinc-plated steel plate (the amount deposited on one surface was 20 g/m$^2$) and a zinc alloy-dip-plated steel plate (the amount deposited on one surface was 60 g/m$^2$) were treated by using the organic composite silicate treating solutions prepared in [A] and [B] above according to the following treating process to obtain sample plates shown in Tables 1 and 2. Treated steel plates outside the scope of the present invention and phosphate-treated and chromate-treated steel plates were used as comparative plates.

| [Treating Process] |
|---|
| Electrically zinc-plated steel plate or zinc alloy-dip-plated steel plate |
| ↓ |
| Surface cleaning (alkali degreasing) |
| ↓ |
| Coating of lithium silicate (concentration of 40 g/l, room temperature, roll coating) |
| ↓ |
| Hot air drying |
| ↓ |
| Hot water washing (60° C.) |
| ↓ |
| Coating of organic composite silicate (concentration of 200 g/l, room temperature, roll coating) |
| ↓ |
| Hot air drying |

The sample plates prepared according to the above-mentioned treating process and the comparative plates are shown in Tables 1 and 2, and the results of the tests made on these plates are shown in Tables 3 and 4.

From the test results shown in Tables 3 and 4, it will readily be understood that the surface-treated steel plate of the present invention is excellent over the conventional phosphate-treated or chromate-treated steel plate and is well-balanced in properties and capacities.

TABLE 1

Plates of the present invention prepared from electrically zinc-plated steel plate (deposited amount of 20 g/m$^2$ on each surface) and comparative plates (underline indicates feature outside scope of the present invention)

| | Lithium · Silicate Film | | Organic composite silicate Film | |
|---|---|---|---|---|
| No | Kind | Amount deposited (g/m$^2$) | Kind | Amount deposited (g/m$^2$) |
| Plates of the invention | | | | |
| 1 | $Li_2O.7.5SiO_2$ | 0.005 | A + B[1] | 2.0 |
| 2 | " | 0.05 | " | " |
| 3 | " | 0.2 | " | " |
| 4 | " | " | " | 0.5 |
| 5 | $Li_2O.3.5SiO_2$ | " | " | 2.0 |
| 6 | $Li_2O.4.5SiO_2$ | " | " | " |
| 7 | $Li_2O.10.0SiO_2$ | " | " | " |
| 8 | " | " | A[2] | " |
| Comparative plates | | | | |
| 9 | $Li_2O.7.5SiO_2$ | 0.0005 | A + B | " |
| 10 | " | 2.0 | " | " |
| 11 | " | 0.2 | " | 0.05 |
| 12 | " | " | " | 5.0 |
| 13 | $Li_2O.7.5SiO_2$ | 0.2 | — | — |
| 14 | — | — | A + B | 2.0 |
| 15 | $Li_2O.1.0SiO_2$ | 0.2 | " | " |
| 16 | Colloidal silica | " | " | " |
| 17 | Phosphate-treated (with chromium sealing) | | | Conventional products |
| 18 | Chromate-treated | | | |

NOTE:
A + B: Treating solution comprising 60 parts (as solids) of the acrylic composite silicate and 40 parts (as solids) of the epoxy composite silicate
A: Treating solution comprising 100 parts (as solids) of the acrylic composite silicate

TABLE 2

Plates of the present invention prepared from zinc-dip-plated steel plate (deposited amount of 60 g/m$^2$ on each surface) and comparative plates (underline indicates feature outside scope of the present invention)

| | Lithium · Silicate Film | | Organic Composite silicate Film | |
|---|---|---|---|---|
| No | Kind | Amount deposited (g/m$^2$) | Kind | Amount deposited (g/m$^2$) |
| Plates of the invention | | | | |
| 1′ | $Li_2O.7.5SiO_2$ | 0.005 | A + B[1] | 2.0 |
| 2′ | " | " | " | " |
| 3′ | " | 0.2 | " | " |
| 4′ | " | " | " | 0.5 |
| 5′ | $Li_2O.3.5SiO_2$ | " | " | 2.0 |
| 6′ | $Li_2O.4.5SiO_2$ | " | " | " |
| 7′ | $Li_2O.10.0SiO_2$ | " | " | " |
| 8′ | " | " | A[2] | " |
| Comparative plates | | | | |
| 9′ | $Li_2O.7.5SiO_2$ | 0.0005 | A + B | " |
| 10′ | " | 2.0 | " | " |
| 11′ | " | 0.2 | " | 0.05 |
| 12′ | " | " | " | 5.0 |
| 13′ | $Li_2O.7.5SiO_2$ | 0.2 | — | — |
| 14′ | — | — | A + B | 2.0 |
| 15′ | $Li_2O.1.0SiO_2$ | 0.2 | " | " |
| 16′ | Colloidal silica | " | " | " |
| 17′ | Phosphate-treated (with chromium sealing) | | | Conventional products |
| | Chromate-treated | | | |

NOTE:
A + B: Treating solution comprising 60 parts (as solids) of the acrylic composite silicate and 40 parts (as solids) of the epoxy composite silicate
A: Treating solution comprising 100 parts (as solids) of the acrylic composite silicate

TABLE 3

Test results of plates prepared from electrically zinc-plated steel plate and comparative plates

| | | Primary corrosion resistance[1] | | Secondary corrosion resistance[2] | Primary corrosion resistance[3] | | Boiling water resistance[4] | | |
|---|---|---|---|---|---|---|---|---|---|
| | No | 48 h | 240 h | (SST 240 h) | Lattice cut test | Lattice cut Erichsen test | 30 min | 180 min | Remarks |
| Plates of the invention | 1 | ○ | x | Δ-○ | ◎ | ○ | ◎ | ◎ | |
| | 2 | ○ | Δ | Δ-○ | ◎ | ○ | ◎ | ◎ | |
| | 3 | ○-◎ | Δ | ○ | ◎ | ○ | ◎ | ◎ | |
| | 4 | ○ | x-Δ | ○ | ◎ | ○ | ◎ | ○ | |
| | 5 | ○-◎ | Δ | Δ-○ | ◎ | ○ | ◎ | Δ-○ | |
| | 6 | ○-◎ | Δ | ○ | ◎ | ○ | ◎ | ○ | |
| | 7 | ○ | x | ○ | ◎ | ○ | ◎ | ◎ | |
| | 8 | ○ | x | ○ | ○-◎ | ○ | ◎ | ◎ | |
| Comparative plates | 9 | Δ | x x | x | ◎ | ○ | ◎ | ◎ | |
| | 10 | ○-◎ | Δ | Δ | Δ | x | ○ | Δ | |
| | 11 | Δ | x x | Δ | ◎ | ○ | ○ | Δ | |
| | 12 | ○-◎ | Δ-○ | ○ | ◎ | ○ | ◎ | ◎ | (A) |
| | 13 | x | x x | x x | ◎ | x x | x x | x x | |
| | 14 | Δ | x x | x | ◎ | ○ | ◎ | ◎ | |
| | 15 | Δ | x | x | Δ | x | Δ | x x | |
| | 16 | Δ | x x | x-Δ | ◎ | ○ | ◎ | ◎ | |
| | 17 | ○ | x x | Δ-○ | ◎ | ○ | ◎ | ○ | (B) |
| | 18 | ○ | x x | Δ | ◎ | Δ | ○ | Δ | |

NOTE:
(A): Spot welding impossible,
(B): Conventional product

TABLE 4

Tests results of the present invention prepared from zinc-dip-plated steel plate and comparative plates

| | No | Primary corrosion resistance[1] 48 h | Primary corrosion resistance[1] 240 h | Secondary corrosion resistance[2] (SST 240 h) | Primary corrosion resistance[3] Lattice cut test | Primary corrosion resistance[3] Lattice cut Erichsen test | Boiling water resistance[4] 30 min | Boiling water resistance[4] 180 min | Remarks |
|---|---|---|---|---|---|---|---|---|---|
| Plates of the invention | 1′ | ○ | x-Δ | ○ | ◎ | ○ | ◎ | ◎ | |
| | 2′ | ○-◎ | Δ | ○-◎ | ◎ | ○ | ◎ | ◎ | |
| | 3′ | ○-◎ | Δ | ◎ | ◎ | ○ | ◎ | ◎ | |
| | 4′ | ○-◎ | Δ | ○-◎ | ◎ | ○ | ◎ | ◎ | |
| | 5′ | ○-◎ | Δ | ○ | ◎ | ○ | ◎ | Δ-○ | |
| | 6′ | ○-◎ | Δ | ◎ | ◎ | ○ | ◎ | ◎ | |
| | 7′ | ○ | Δ | ◎ | ◎ | ○ | ◎ | ◎ | |
| | 8′ | ○ | Δ | ◎ | ◎ | ○ | ◎ | ◎ | |
| Comparative plates | 9′ | Δ | x | Δ | ◎ | ○ | ◎ | ◎ | |
| | 10′ | ○-◎ | Δ-○ | Δ | Δ | Δ | ○ | Δ | |
| | 11′ | Δ | x | Δ | ◎ | ○ | ◎ | Δ | |
| | 12′ | ○-◎ | ○ | ◎ | ◎ | ○ | ◎ | ◎ | (A) |
| | 13′ | Δ | x | x | ○ | x | x x | x x | |
| | 14′ | Δ | x | Δ | ◎ | ○ | ◎ | ◎ | |
| | 15′ | Δ | x | Δ | Δ | x | Δ | x x | |
| | 16′ | Δ | x | Δ | ◎ | ○ | ◎ | ◎ | |
| | 17′ | ○ | x | ○ | ◎ | ○ | ○ | Δ | (B) |

NOTE:
(A): Spot welding impossible,
(B): Conventional product

Note

(1) Primary Corrosion Resistance

The uncoated surface-treated steel plate was subjected to the salt spray test for 24 hours and 240 hours according to the method of JIS Z-2371, and the white rust-appearing area was measured and the primary corrosion resistance was evaluated according to the following scale:

| Evaluation | White Rust-Appearing Area |
|---|---|
| ◎ | no |
| ○ | 1–10% |
| Δ | 11–25% |
| x | 26–50% |
| xx | more than 50% or red rust |

(2) Secondary Corrosion Resistance (Corrosion Resistance of Coating)

A melamine-alkyd resin type paint (baked at at 140° C. for 20 minutes, film thickness of 30μ, pencil hardness of H to 2 H) was coated, and cross cuts were formed on the coating and the salt spray test was carried out for 240 hours according to the method of JIS Z-2371. The sample was then allowed to stand in a room for about 12 hours and an adhesive cellophane tape was applied to the cross-cut coating. The tape was instantaneously peeled and the average peel width (mm) on one side was calculated according to the following formula:

$$\text{Average peel width (mm) on one side} = \frac{\text{average peel width (mm) of cross-cut portion}}{2}$$

| Evaluation of Average Peel Width on One Side | Average Peel Width |
|---|---|
| ◎ | 0–0.5 mm |
| ○ | 0.6–1.0 mm |
| Δ | 1.1–2.0 mm |
| x | 2.1–3.0 mm |
| xx | 3.1 mm or more |

(3) Primary Adhesion (Paint Adhesion)

The above-mentioned paint was coated and, the square cut adhesion test and square cut Erichsen test were carried out and the damages on the coated surface were examined.

Square Cut Adhesion Test

Eleven cut lines were formed at intervals of 1 mm in either the longitudinal direction or the lateral direction to form 100 square cuts, and an adhesive cellpophane tape was applied to the cut coated surface and was instantaneously peeled.

Cut Erchsen Test

Square cuts were formed in the above-mentioned manner, and the sample was extruded by an Erichsen extruder and an adhesive cellophane tape was applied and instantaneously peeled.

The results of the square cut test and square cut Erichsen test were evaluated according to the following scale:

| Evaluation | Damages on Surface of Coating |
|---|---|
| ◎ | no change |
| ○ | slight peeling of coating |
| Δ | some peeling of coating |
| x | considerable peeling of coating |
| xx | peeling of major portion of coating |

(4) Boiling Water Resistance

The above-mentioned paint was coated and the coated plate was dipped in boiling water for a predetermined time (30 minutes or 180 minutes), and formation of blisters was checked.

| Evaluation | Formation of Blister on Surface of Coating |
|---|---|
| ◎ | no blister |
| ○ | a few (several) blisters |
| Δ | some blisters |
| x | considerable blisters |
| xx | large blisters on entire coating surface |

What is claimed is:

1. A multi-layer surface-treated steel plate consisting essentially of a zinc-containing plating layer, a lithium silicate film layer formed on said plating layer and an organic composite silicate film layer composed of colloidal silica and an organic resin, which is formed on the lithium silicate film layer.

2. A multi-layer surface-treated steel plate as set forth in claim 1, wherein the zinc-containing plating layer is a zinc plating layer.

3. A multi-layer surface-treated steel plate as set forth in claim 1, wherein the zinc-containing plating layer is a zinc alloy plating layer.

4. A multi-layer surface-treated steel plate as set forth in claim 1, wherein the amount of the lithium silicate film layer deposited on one surface is 0.001 to 1 $g/m^2$ and the amount of the organic composite silicate film layer deposited on one surface is 0.1 to 4.0 $g/m^2$.

5. A multi-layer surface-treated steel plate as set forth in claim 1, wherein the amount of the lithium silicate film layer deposited on one surface is 0.01 to 0.5 $g/m^2$.

6. A multi-layer surface-treated steel plate as set forth in claim 1 or 5, wherein the amount of the organic composite silicate film layer deposited on one surface is 0.5 to 3.0 $g/m^2$.

7. A multi-layer surface-treated steel plate as set forth in claim 1 or 4, wherein in the lithium silicate ($Li_2O.nSiO_2$) film layer, the molar ratio n is in the range of from 2 to 20.

8. A multi-layer surface-treated steel plate as set forth in claim 1, wherein the organic resin in the organic composite silicate film layer is selected from acrylic copolymers, alkyd resins, epoxy resins, fatty acid- and polybasic acid-modified polybutadiene resins, polyamine resins and polycarboxylic acid resins, each having hydrophilic groups such as hydroxyl, carboxyl and amino groups in the molecule, and mixtures and addition condensates of at least two members of the said resins.

* * * * *